US005796061A

United States Patent [19]

Fabrizi et al.

[11] Patent Number: 5,796,061

[45] Date of Patent: Aug. 18, 1998

[54] MINIATURIZED AUTOMATIC CIRCUIT BREAKER WITH A MULTI-FUNCTIONAL TERMINAL AND A SCREEN FOR PROTECTION AGAINST INTERNAL ELECTRIC ARCS

[75] Inventors: Fabrizio Fabrizi, Bergamo; Sergio Pianezzola, Varese, both of Italy

[73] Assignee: Bticino S.p.A., Milan, Italy

[21] Appl. No.: 666,415

[22] PCT Filed: Oct. 17, 1995

[86] PCT No.: PCT/EP95/04081

§ 371 Date: Sep. 23, 1996

§ 102(e) Date: Sep. 23, 1996

[87] PCT Pub. No.: WO96/12292

PCT Pub. Date: Apr. 25, 1996

[30] Foreign Application Priority Data

Oct. 18, 1994 [IT] Italy ..... MI94A2126

[51] Int. Cl.[6] ..... H01H 33/04

[52] U.S. Cl. ..... 218/157; 218/156

[58] Field of Search ..... 218/155, 156, 218/157, 158

[56] References Cited

U.S. PATENT DOCUMENTS

| | | | |
|---|---|---|---|
| 3,683,140 | 8/1972 | Peck | 218/17 |
| 3,891,298 | 6/1975 | Yorgin et al. | 339/272 R |
| 4,649,242 | 3/1987 | Kralik | 218/34 |
| 5,493,092 | 2/1996 | Rowe | 218/156 |

FOREIGN PATENT DOCUMENTS

| | | |
|---|---|---|
| 9310186 | 8/1983 | Germany . |
| 4303550 | 8/1993 | Germany . |
| 9406404 | 6/1994 | Germany . |

*Primary Examiner*—Matthew V. Nguyen

*Attorney, Agent, or Firm*—Ostrolenk, Faber, Gerb & Soffen, L.L.P.

[57] ABSTRACT

In a miniaturized automatic circuit breaker with a casing of insulating material forming an arc-extinguishing chamber and a housing for contacts which are closed and opened and for a pair of terminals for connection to ends of leads outside the circuit breaker, one of the terminals is multifunctional and comprises a screw clamp opening in a first face of the circuit breaker in order to receive ends of external leads and spring-clip terminal opening in the rear face of the circuit breaker for receiving a blade-like terminal of an external lead, and an insulating diaphragm is interposed between the multifunctional terminal and the arc-extinguishing chamber and forms, with the casing, at least one vent duct opening in the first face and insulated electrically from the multifunctional terminal.

14 Claims, 3 Drawing Sheets

MINIATURIZED AUTOMATIC CIRCUIT BREAKER WITH A MULTI-FUNCTIONAL TERMINAL AND A SCREEN FOR PROTECTION AGAINST INTERNAL ELECTRIC ARCS

BACKGROUND OF THE INVENTION

1. Field of the Invention

The present invention relates to a miniaturized automatic switch (or circuit breaker) with a multifunctional terminal and a screen for protection against internal electrical arcs.

Modular miniaturized automatic circuit breakers for installation on rails with arrangements of several juxtaposed modules are known.

2. Description of the Related Prior Art

A circuit breaker of this type is constituted by a generally parallelepipedal, flattened rectangular casing of insulating material with two larger parallel faces or sides and further smaller faces corresponding, in relation to the conditions of installation, to a rear face, a front face, an upper face and a lower face.

The casing is formed by two half-shells coupled in a plane parallel to the sides and houses the various mechanical and electrical components of the circuit breaker.

The arrangement of the various components and access thereto from outside depend on their functions and the method of installation. For example, the rear face of the casing has to be dedicated to the mechanical installation of the circuit breaker on the support and has a recess for housing a rail and support on which the circuit breaker is engaged by means of sliding teeth disposed on the rear wall.

The manually operated circuit-breaker indicating members face the front and first and second terminals for clamping external electrical terminals open on the lower and upper faces, respectively.

The flat sides of the circuit breaker must have no obstructions or accesses to internal components except those necessary and provided specifically for establishing any mechanical interaction between juxtaposed modules.

Among the essential components of a circuit breaker of this type, which must be able to interrupt high-intensity currents, is the labyrinth for extinguishing (or, more correctly, breaking up) the electric arc which develops between the contacts of the circuit breaker when they open. This labyrinth is housed in an arc-extinguishing chamber.

As well as ionizing the air housed in the extinguishing chamber, the high arc temperatures cause a considerable increase in its pressure which may cause the circuit breaker to explode and, in order to prevent this, it is necessary to provide suitable vents for the ionized air.

These vents have to convey the ionized air away from components which are under tension or electrically conductive to avoid the striking of electric arcs or discharges due to the conductivity of the ionized gas.

The effectiveness and speed of the arc-extinguishing devices also depends upon the speed with which the ionized air under excess pressure is discharged from the extinguishing chamber.

In most automatic circuit breakers, this discharge takes place through a discharge duct opening in the lower or upper face of the circuit breaker and passing between one of the terminals and the rear face.

The duct is advantageously insulated from the terminal by means of ribs of the two half-shells which, although they are not hermetically sealed, form a labyrinth which is effective in preventing the flow of ionized air towards the terminal.

Automatic circuit breakers with third contact terminals with spring clips for the insertion of external blade or pin terminals have recently been introduced on the market, the third terminal opening in the rear wall of the circuit breaker and being electrically connected to one of the other two.

In this case, it is not possible to form the discharge duct between one of the two terminals and the rear wall owing to the presence of the third terminal and the respective electrical connection with one of the two terminals. This necessitates the provision of much less effective discharge openings at other points in the casing.

A further disadvantage of circuit breakers of this type with three terminals is constituted by the greater structural complexity, by the larger number of components to be assembled and interconnected and by the inevitable localized contact resistances which are formed during the electrical connection of physically separate conductor elements, even by soldering.

A further disadvantage is also constituted by the considerable thrust which has to be exerted in order to open the spring clip of the terminal and insert the external blade terminal.

SUMMARY OF THE INVENTION

These problems are eliminated by the miniaturized automatic circuit breaker of the present invention which has a multifunctional terminal which jointly performs the function of a screw clamp and the function of a spring-clip contact terminal and also has an insulating, protecting screen which surrounds the ends of the spring clip and, with ribs of the casing, forms a diaphragm separating the arc-extinguishing chamber and the terminal with a labyrinth-like seal, and a pair of vent ducts disposed beside the spring clip of the terminal and insulated therefrom.

Advantageously, according to a further aspect of the present invention, the insulating screen also has a preloading wedge which, by partially opening the clip, facilitates the insertion of the contact pin and reduces the force to be exerted for this operation.

According to a further aspect of the present invention, the contact clip is produced in a single piece with a terminal block without the need for interconnection operations, eliminating any possible cause of localized resistance and reducing the number of components and the assembly operations to a minimum.

The characteristics and advantages of the invention will become clearer from the following description of a preferred embodiment of the invention given with reference to the appended drawings, in which:

DESCRIPTION OF THE PREFERRED EMBODIMENTS

Figure 1:
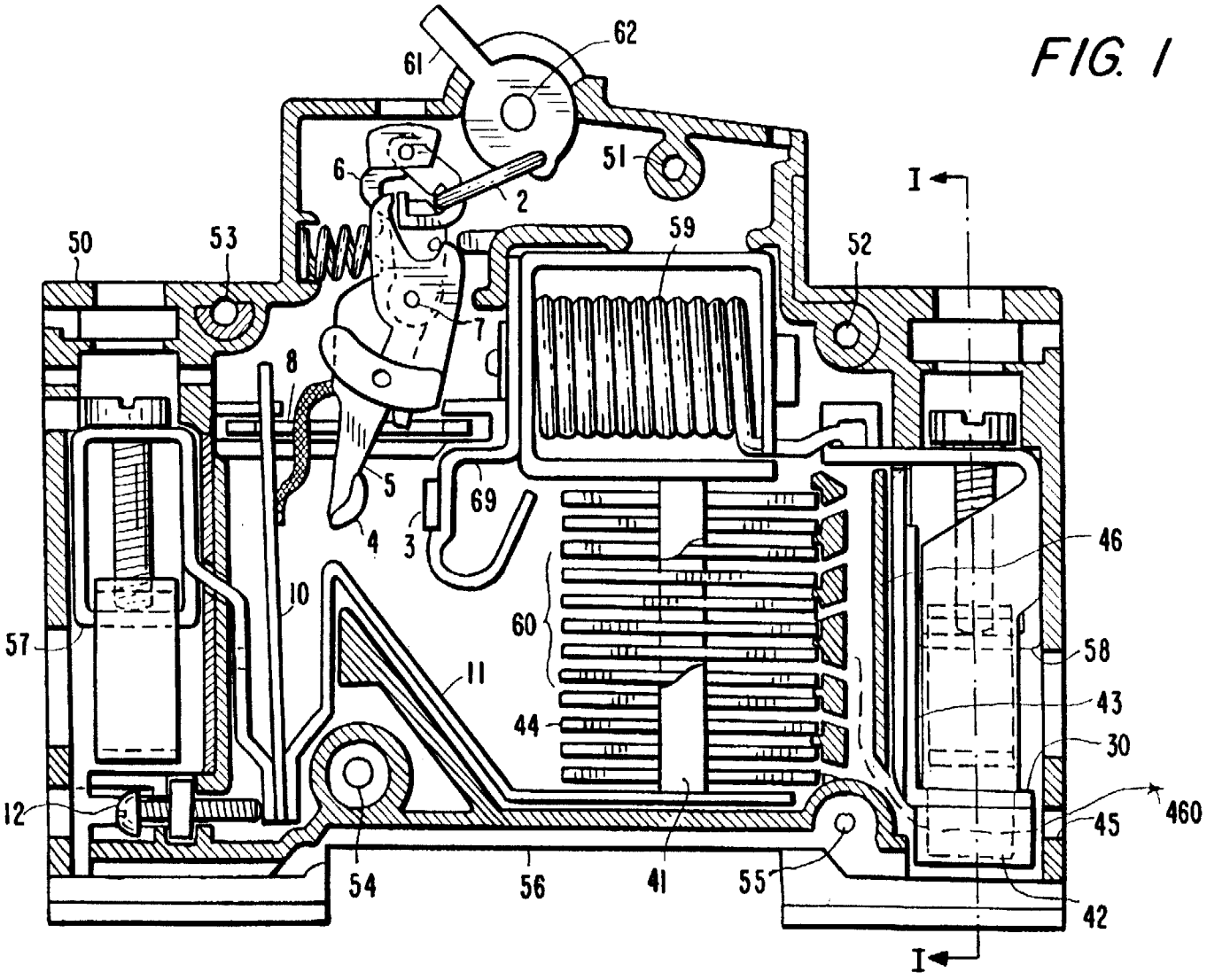
FIG. 1 is an overall sectioned view of a preferred embodiment of the circuit breaker according to the present invention.

With reference to FIG. 1, a miniaturized automatic circuit breaker according to the invention comprises a generally parallelepipedal, rectangular casing 50 constituted by two coupled half-shells, one of which is shown sectioned in the coupling plane to place greater emphasis on the internally ribbed structure of the two half-shells.

The frames and the internal ribs of the two half-shells interpenetrate in a suitable manner and precisely position the two half-shells relative to one another and the various components housed relative to the casing. The two half-shells are fixed together by means of screws or rivets extending through holes 51, 52, 53, 54, 55, perpendicular to the plane of the drawing.

The circuit breaker shown is a modular circuit breaker for installation on a rail with several modules arranged side by side along the faces of the casings parallel to the coupling plane of the half-shells or side faces.

The circuit breaker has a recess 56 in its rear wall for housing a standard DIN rail on which the circuit breaker is engaged by means of toothed engagement slides not shown.

A plurality of mechanical and electrical components is housed and precisely positioned in the casing; in particular, these are:

- first and second terminals 57, 58, respectively, for electrical connection to ends of external leads,
- a bimetal plate 10 with one end connected electrically and mechanically to the terminal 57,
- an electromagnet 59,
- an arc-extinguishing labyrinth 60 also known as a deionizing cell,
- a manual arming lever 61 articulated on a pin 62 in a fixed position in the casing and connected to an arming rod 2,
- a fixed contact 3 supported by a rigid metal appendage 69 of the electromagnet 59 electrically connected to a terminal of the electromagnet winding, the other terminal being connected to the terminal 58,
- a movable contact 4 on the end of a contact arm 5 of conductive material electrically connected to the bimetal plate by a flexible copper braid,
- a release device including the contact arm 5 and other elements collectively indicated 6 and having a pivot pin 7 engaged in a fixed position on the casing;
- a slide 8 for unidirectional mechanical coupling between the bimetal plate 10 and the release device,
- a switching and arc-guide electrode 11 electrically connected to the bimetal plate 10, and
- a thermal protection calibration screw 12.

Since the release device falls outside the scope of the present invention a detailed description thereof is not supplied, and it is indicated simply that it may constitute, in a known manner, a unitary subassembly which can easily be installed in the casing by the engagement of the ends of the pin 7 in suitable seats in the two half-shells.

The overall view gives an idea of the structural complexity of the circuit breaker, of the assembly difficulties, of the compactness requirements and the small size which the various components must have in order to be housed in a casing of limited dimensions, and of the mutual arrangement of the components.

The operation of a circuit breaker of this type is known:

- when the release device is armed manually, the two contacts 3 and 4 are closed and electrical continuity between the terminals 57 and 58 is ensured.

In the event of overloading or short-circuit, the respective thermal (bimetal) and magnetic (electromagnet) protection devices activate the tripping device causing the contacts 3 and 4 to open.

The electric opening arc which develops between the contacts 3 and 4 travels from the contact 4 to the arc-guide electrode 11 which guides it towards the deionizing cell 60, increasing its length.

The cell is constituted by a plurality of parallel metal plates 40 spaced apart by spacers of insulating material which are disposed on the sides and of which one 41 is shown partially.

The flow of ionized air caused by the arc penetrates between the metal plates which break up the arc and cause it to be extinguished, taking on a potential variable between the potential of the contact 3 and the potential of the contact 4.

The difference between the two potentials, disregarding the voltage drop in the winding of the electromagnet 59, is, of course, equal to the instantaneous value of the mains voltage applied to the terminals 57 and 58.

The flow of ionized air which flows between the plates 40 must be discharged from the casing whilst being prevented from passing over the terminal 58 and establishing an electric arc between the plates nearest the arc guide 11 and the terminal 58 a spring-clip contact 42 of which extends towards the rear face of the circuit breaker to form a third clip contact terminal.

Reliable insulation between the metal plates 40 and the clip 42 is formed by a diaphragm 43 of insulating material, preferably thermoplastic resin, engaged between the two half-shells and cooperating with ribs 46 of the half-shells to form a labyrinth-like seal.

The diaphragm 43 is extended by a hollow cap 30 opening towards the rear face of the circuit breaker for housing the end of the spring clip 42 forming, with the two half-shells, a pair of vent ducts which open into a hole 45 in the upper face of the casing.

The ionized air under excess pressure coming from the deionizing cell 60 can thus flow towards the outside of the circuit breaker along the flow line indicated by the arrow 460.

Figure 2:
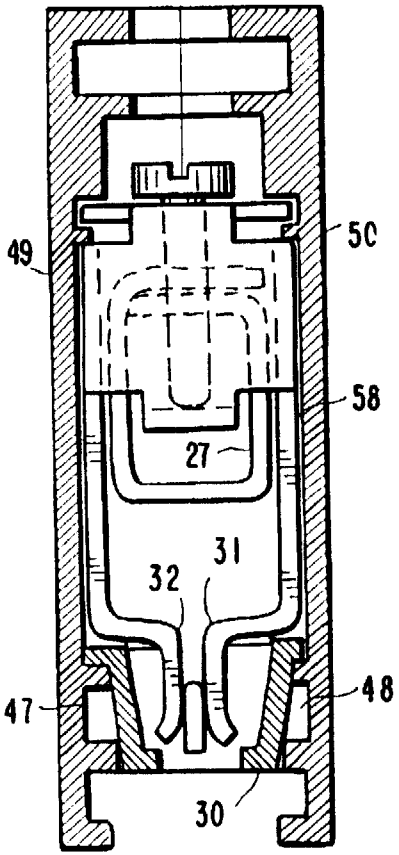
FIG. 2 is a section of a detail of the circuit breaker of FIG. 1, taken on the line I—I of FIG. 1

FIG. 2 is a section of a detail of the circuit breaker taken on the line I—I of FIG. 1 and shows clearly the two vent ducts 47, 48 formed between the two half-shells 50, 49 and the hollow cap 30, as well as the ends or lips 31, 32 of the spring clip.

Figure 3:
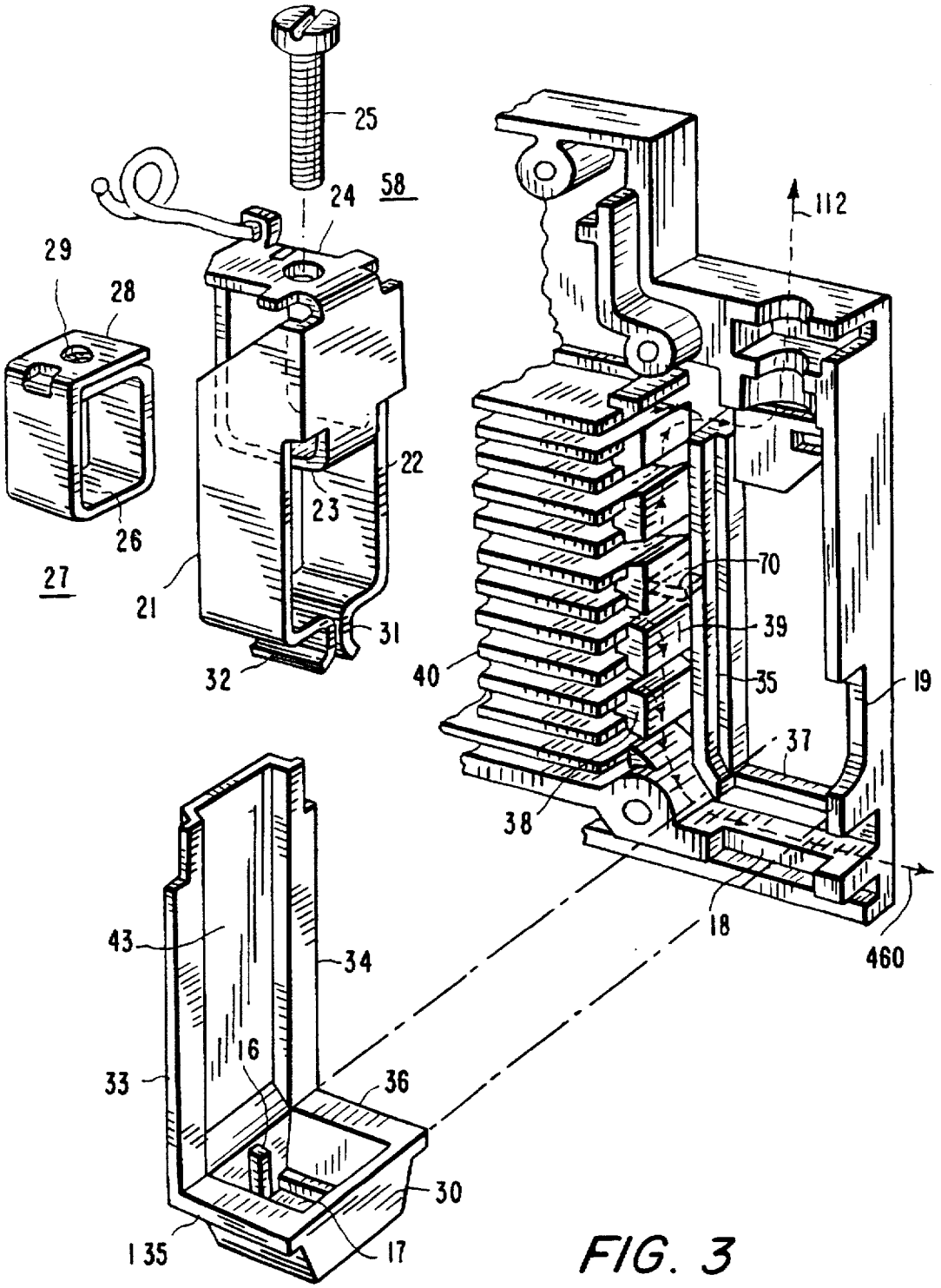
FIG. 3 is an exploded, perspective view of a multifunctional terminal, an insulating protecting diaphragm and a portion of the casing of the circuit breaker of FIG. 1.

FIG. 3 is an exploded perspective view of some details of FIG. 1 and shows clearly the diaphragm 43 with the hollow cap 30.

The edges 33, 34 of the diaphragm 43 have double L-shaped cross-sections and engage between a pair of ribs of the half-shells, of which one 35 is visible in FIG. 3. When the diaphragm 43 is housed in its seat, the edge 34 mates with the rib 35.

Similarly, the hollow cap 30 has two flanges 135, 36 which engage between a pair of ribs of the half-shells, of which one 37 is visible in FIG. 3. The flange 36 mates with the rib 37 along a dihedral.

The diaphragm 43 and the respective cap 30 thus form, with the two half-shells, a housing for the terminal separate and electrically insulated from the arc-extinguishing chamber throughout the height of the pack plates 40 for breaking up arcs.

In addition to the spacers such as 41 (FIG. 1), these plates are kept in position by suitable ribs 38 of the half-shells between which holes are formed for access to a manifold vent duct 39 communicating with the two vent ducts 47, 48 (FIG. 2) and formed between the ribs 38 and the rib 35.

Figure 4:
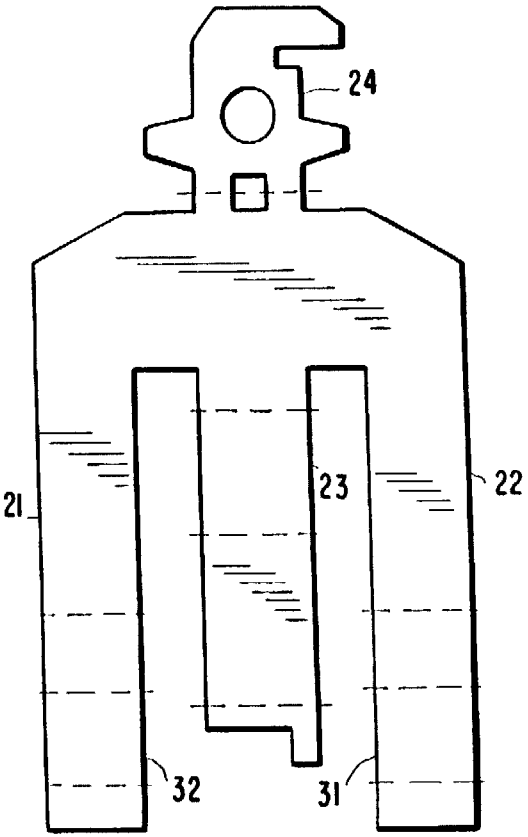
FIG. 4 shows a blank of conductive plate for forming the multifunctional terminal of FIG. 3.

The multifunctional terminal 58 of the circuit breaker is produced by the bending of a flat blank formed by a metal plate or strip advantageously blanked and shown in FIG. 4. The blank comprises an elongate central body 20 with two arms 21, 22 parallel to the body.

As shown in FIG. 3, a terminal block configured as a rectangular loop is produced by bending of the central body, one face 23 of the block constituting a fixed jaw of the terminal. The face 24 of the block opposite and parallel to the face 23 has a hole through which a clamping screw 25 of the terminal can pass freely.

A rectangular metal ring 27 is linked with the terminal block, one face 26 of the ring constituting the movable jaw of the terminal. The face 28 of the ring 27 opposite and parallel to the face 26 has a threaded hole 29 into which the screw 25 is screwed.

The tightening of the screw 25, the end of which pushes against the face 23 of the terminal block causes the face 26 to move towards the face 23 consequently clamping ends of external connectors interposed between them. The external ends are inserted between the jaws 23, 26 through a hole 19 in the casing of the circuit breaker. In addition to the function of a screw-clamp terminal, the terminal 58 also performs the function of a clip terminal for a blade end.

The arms 21, 22 of the blank are bent parallel to one another to enclose the ring 27 beyond which they extend and are bent towards one another forming two lips 31, 32 of a compression spring clip between which a blade or flattened pin end is inserted. The screw-clamp terminal block and the contact clip of a clip terminal are thus produced in a single piece without the need for mechanical or electrical connections.

As already stated, the lips 31, 32 are housed in the cap 30 and a connection blade is inserted between the lips through a slot 18 opening in the rear wall of the casing and a hole 17 in the head of the cap 30 without the risk of striking arcs between the plates 40, the arms 21, 22 or the lips 31, 32 which are advantageously insulated owing to the presence of the diaphragm 43 and its cap 30. In addition to the function of insulating the arms of the clip terminal, the diaphragm 43 advantageously also mechanically preloads them.

A problem which cannot be ignored with spring clip terminals is in fact the large insertion force which has to be exerted in order to insert the blade terminal between the lips. To ensure a good electrical contact with a carrying capacity even of the order of tens of amps an adequate contact pressure, and hence a predetermined compression force acting between the lips, is in fact necessary.

The force necessary to insert a blade between the lips is due not only to the resistant friction component, which in normal conditions is negligible, but to the work which it is necessary to perform to open the bevelled lead-in formed by the lips by the amount corresponding to the thickness of the blade.

Since, for reasons of bulk, the bevel has an initial opening angle of the order of 900 which gradually decreases, as can easily be demonstrated, the initial force for the insertion of a blade is equal to twice the compression force exerted between the contacts.

In order to avoid this problem, in the housing for the lips, the cap 30 has a tooth 16 of a thickness a little less than the thickness of the external terminal blade, as shown in FIG. 3.

Figure 5:
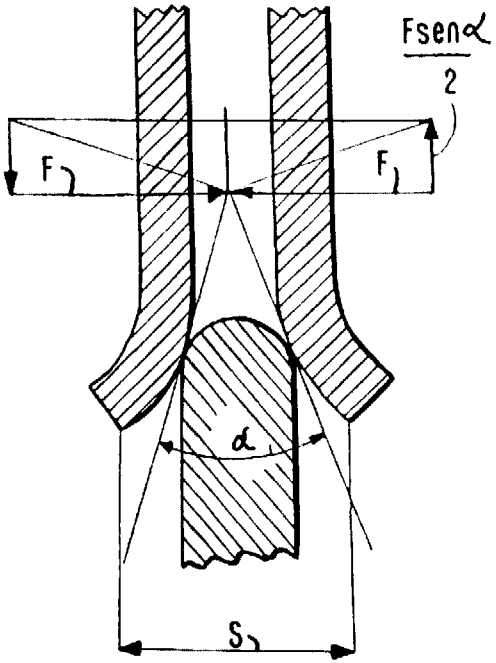
FIG. 5 shows schematically and in section the insertion of a blade terminal in the spring clip of the terminal of FIG. 3 and the resultant insertion forces.

When the lips 31, 32 are inserted in the cap 30, the tooth 16 interferes with the lips and opens them. This achieves the dual advantage of increasing the lead-in section S for the blade 15, facilitating the relative positioning of the blade in the lead-in, and of considerably reducing the force of the insertion operation, as shown in FIG. 5. In fact, the lips 31, 32 have ends which are opened out by bending and are therefore rounded to a certain extent.

If the two lips are spaced apart beforehand by an amount close to the thickness of the blade, the blade interferes with the lips on two generatrices which are contained in two planes tangential to the surfaces of the lips and forming a dihedral with a relatively small opening.

The remaining force to open the lips can thus be achieved by a very small insertion force equal to F sin a/2 where F is the contact pressure between the lips and a is the opening angle of the dihedral.

The foregoing description relates solely to a preferred embodiment and clearly many variations and many refinements can be applied.

For example, although the multifunctional terminal 58 is advantageously formed by a one-piece block and contact clip, it could be produced by the mechanical combination of several separate parts.

Moreover, in addition to the vent ducts 47, 48 and the vent holes 45, there may be further vent ducts which discharge ionized air conveyed by the plates 40 further from the switching electrode 11 and hence at a potential closer to that of the terminal 58, of the contact 3 and of the electromagnet 59.

For example, as shown in FIG. 3, as well conveying the ionized flow as along the path indicated by the arrow 460, the manifold duct 39 may also convey some of the ionized flow also along the path indicated by the arrow 112 towards holes arranged in the front wall of the casing, if necessary, or already present for other purposes such as the tightening of the screw 25 from the front of the circuit breaker.

In this case it is advisable to separate the manifold duct 39 into two distinct portions isolated from one another by a partition wall produced either as an extension of one of the ribs 38 as far as the insulating diaphragm 43 or as a projecting extension of the insulating diaphragm 43. In FIG. 3, the partition wall is shown by the broken line indicated 70.

We claim:

1. A circuit breaker in which electrical continuity between first and second terminals for connection to ends of leads outside the circuit breaker is controlled by a manual arming and disarming device and by overload protection devices operating automatically by means of the opening of two contacts, and the arc caused by the opening of the contacts develops and excess pressure of ionized air in an arc-extinguishing chamber housing a deionizing cell, characterized in that the first of the terminals comprises:

a screw claim terminal opening in a first face of the circuit breaker for receiving ends of external leads and a spring-clip terminal opening in a rear face of the circuit breaker for receiving a blade terminal of an external lead, and in that the circuit breaker comprises an insulating diaphragm interposed between the first terminal and said deionizing cell, separate from and forming with an insulating casing of the circuit breaker at least one vent duct opening in the first face and electrically insulated from the first terminal.

2. A circuit breaker according to claim 1, in which the diaphragm has edges coupling with ribs of said casing and forming a labyrinth-like seal.

3. A circuit breaker according to claim 1, in which the diaphragm has a hollow cap-like end forming a housing for contact lips of said spring clip terminal.

4. A circuit breaker according to claim 3, in which the hollow cap has a preloading tooth for opening the contact lips.

5. A circuit breaker according to claim 1, in which said spring clip terminal is formed integrally with a terminal block of said screw clamp terminal comprising a clamping jaw of said screw-clamp terminal.

6. A circuit breaker according to claim 5, in which the spring clip terminal and the terminal block are formed by the bending of a unitary flat blank.

7. A circuit breaker according to claim 2, in which the diaphragm has a hollow cap-like end forming a housing for contact lips of said spring clip terminal.

8. A circuit breaker according to claim 7, in which the hollow cap has a preloading tooth for opening the contact lips.

9. A circuit breaker according to claim 2 in which said spring clip terminal is formed integrally with a terminal block of said screw clamp terminal comprising a clamping jaw of said screw-clamp terminal.

10. A circuit breaker according to claim 3 in which said spring clip terminal is formed integrally with a terminal block of said screw clamp terminal comprising a clamping jaw of said screw-clamp terminal.

11. A circuit breaker according to claim 4 in which said spring clip terminal is formed integrally with a terminal block of said screw clamp terminal comprising a clamping jaw of said screw-clamp terminal.

12. A circuit breaker according to claim 7 in which said spring clip terminal is formed integrally with a terminal block of said screw clamp terminal comprising a clamping jaw of said screw-clamp terminal.

13. A circuit breaker according to claim 8 in which said spring clip terminal is formed integrally with a terminal block of said screw clamp terminal comprising a clamping jaw of said screw-clamp terminal.

14. A circuit breaker according to any of claims 1–5 and 7–13, in which the spring clip terminal and the terminal block are formed by the bending of a unitary flat blank.

* * * * *